US005829538A

United States Patent [19]

Wesson et al.

[11] Patent Number: 5,829,538

[45] Date of Patent: Nov. 3, 1998

[54] FULL BORE GUN SYSTEM AND METHOD

[75] Inventors: David S. Wesson, Waxahachie; Don Shewchenko, Fort Worth, both of Tex.

[73] Assignee: Owen Oil Tools, Inc., Fort Worth, Tex.

[21] Appl. No.: 814,631

[22] Filed: Mar. 10, 1997

[51] Int. Cl.[6] ..... E21B 43/117

[52] U.S. Cl. ..... 175/4.6; 102/321; 166/55.1; 166/297

[58] Field of Search ..... 175/4.6; 166/297, 166/55.1; 102/321, 323

[56] References Cited

U.S. PATENT DOCUMENTS

| | | | |
|---|---|---|---|
| 2,749,840 | 6/1956 | Babcock | 175/4.6 |
| 2,968,243 | 1/1961 | Turechek | 175/4.6 |
| 3,211,093 | 10/1965 | McCullough et al. | 175/4.6 |
| 3,233,688 | 2/1966 | Bell | 175/4.6 |
| 3,706,344 | 12/1972 | Vann | 166/297 |
| 4,739,707 | 4/1988 | Regalbuto et al. | 175/4.6 |
| 5,323,684 | 6/1994 | Umphries | 175/4.6 |
| 5,598,891 | 2/1997 | Snider et al. | 175/4.6 |

*Primary Examiner*—Hoang C. Dang
*Attorney, Agent, or Firm*—Charles D. Gunter, Jr.

[57] ABSTRACT

A tubing conveyed perforating apparatus is shown which includes a tubular assembly made up of a plurality of tubular sections. One or more elongate charge holders are located within the interior bore of the tubular assembly and carry explosive charges thereon. A firing head is carried on the tubular assembly for detonating the explosive charges to perforate a surrounding well bore. The charge holders and explosive charges are comprised of materials which disintegrate upon detonation of the explosive charges, whereby the interior bore of the tubular assembly is fully open after detonation.

20 Claims, 4 Drawing Sheets

FULL BORE GUN SYSTEM AND METHOD

BACKGROUND OF THE INVENTION

1. Field of the Invention

The present invention relates generally to a tubing conveyed perforating gun system of the type used to perforate a well bore for the production of well bore fluids and, specifically, to such a system with internal components which disintegrate upon detonation of the associated firing system so that the interior bore of the tubing string is fully open after detonation.

2. Description of the Prior Art

As oil and gas well bores are being drilled, the integrity of the borehole is preserved by cementing a casing or liner in place in the borehole. The casing or liner is a metal, cylindrical conduit which must be punctured or perforated over the desired production interval in order to produce well bore fluids once drilling is complete. A perforating gun which utilizes some form of fired projectile and an explosive charge is used to perforate the casing or liner to begin production from the well.

Prior perforating gun techniques have either utilized tools which were run on a wireline or cable or have utilized tubing conveyed devices which were run on a tubing string to a desired depth in a well bore. Tubing conveyed devices have certain advantages over wireline methods, for example, in allowing safe, immediate release of formation pressure at maximum pressure differentials into the tubing string. With tubing conveyed perforating systems, the tubing can be run into position, a packer set to seal off the well bore, and the surface well head equipment can be installed. The packer setting can be checked by circulating fluid under pressure through the well annulus or through the well tubing string. Once the surface work is completed and tested for safety, the perforating gun can be fired to bring in the well. Since all surface work is completed before the perforating gun is fired, operating safety is enhanced.

Once the perforating gun has been fired and the casing is perforated, there are basically three methods for dealing with the remaining perforating apparatus: (1) the perforating guns can be dropped to the bottom of the well bore with a mechanical gun release or automatic gun release; (2) the guns can be removed from the well; or (3) the guns can remain on the tubing. In the past, the first alternative was generally the best, since releasing the perforating gun portion of the apparatus from the remainder of the tubing string provided a greater flow area through the tubing string for production of well bore fluids and also allowed tools and other devices to be run through the interior bore of the tubing string without contacting the perforating gun apparatus. However, this choice generally required an extra "rat hole" to be drilled. Removing the perforating gun portion of the apparatus from the well also offered the advantages of a full open bore but required a separate trip out of the well adding to the overall expense and risking damage to the productivity of the well. The third alternative of leaving the guns in the well bore was the least desirable since the perforating apparatus cannot be left adjacent the producing area in the well if production logging or other work is desired.

The present invention has as its object to provide a tubing conveyed perforating apparatus which can be conveyed on production casing or tubing, positioned in a well bore adjacent a producing formation and fired and which automatically becomes full bore thereafter to allow logging tools to be conveyed through the gun portion of the apparatus.

Another object of the invention is to provide a tubing conveyed perforating apparatus which provides a tubing string with a full open interior bore after firing and without requiring a separate trip out of the well or the drilling of an additional "rat hole."

Another object of the invention is to provide a tubing conveyed perforating apparatus which features a tubular assembly including a plurality of tubular sections which are threadedly connected by external collars, whereby the interior bore of the tubular assembly adjacent the firing section is of generally constant internal diameter.

Another object of the invention is to provide such a perforating apparatus with a firing head which is either automatically ejected after firing or which can be pulled via a wireline or slickline to the well surface.

Another object of the invention is to provide a perforating apparatus with internal components made of materials which will disintegrate upon detonation.

Another object of the invention is to provide a perforating apparatus which is initially sealed at an upper end by a firing head and which is initially sealed at a lower end by a self-releasing plug so that the charge carrying portion of the device is initially isolated in an atmospheric chamber.

Another object of the invention is to provide such an apparatus which is simple in design and economical to manufacture.

SUMMARY OF THE INVENTION

The tubing conveyed perforating apparatus of the invention includes a tubular assembly made up of a plurality of tubular sections. Each of the tubular sections has a generally cylindrical exterior and a concentric interior bore. The tubular assembly has an upper connecting end for connection in a tubular string extending to the well surface and a lower end. An elongate charge holder is located within the interior bore of the tubular assembly. A plurality of explosive charges are mounted on the charge holder. A plurality of elongate charge holders can be arranged end to end and extend downwardly within the tubular assembly. The tubular sections of the tubular assembly which surround the charge holders are threadedly connected by external collars, whereby the interior bore of the tubular assembly which contains the charge holders is of generally constant internal diameter. A firing head is provided for detonating the explosive charges to perforate the surrounding well bore. The charge holder and plurality of explosive charges are comprised of materials which disintegrate upon detonation of the explosive charges, whereby the interior bore of the tubular assembly is fully open after detonation.

Preferably, the firing head includes release means for automatically releasing the firing head upon detonation of the explosive charges, thereby allowing the firing head to fall through the interior bore of the tubular assembly into the well bore below the apparatus. Alternatively, the firing head can include a connecting end for connection to a retrieval apparatus which is run from the well surface, whereby the firing head can be pulled from the well bore upon detonation.

The firing head is preferably located above the elongate charge carriers within the interior bore of the tubular assembly and initially seals off the interior bore thereof from above. A self-releasing plug is mounted at the lower end of the tubular assembly for initially sealing the interior bore from below. The interior bore of the tubular assembly between the firing head and self-releasing plug is initially an air-filled, atmospheric chamber.

In the method of the invention, a tubing conveyed perforating apparatus and a packer means are suspended from a tubing string at a subterranean location within a well bore. The packer is set within the well bore at a position which isolates a lower borehole portion of the well bore from an upper borehole portion thereof and which locates the perforating apparatus adjacent the production interval. The perforating apparatus is actuated to perforate the well casing adjacent the production interval to thereby allow production fluids to flow through the perforated interval, through a surrounding annular area of the well and upwardly through the tubing string to the well surface. The charge holder and explosive charges which make up the internal components of the perforating apparatus are formed from a disintegratable material which disintegrates during detonation of the explosive charges, whereby the interior bore of the tubular assembly is fully open after detonation.

The disintegratable components of the tubular assembly are initially isolated within the interior bore thereof at an upper end by the firing head and at the lower end by a self-releasing plug. The act of detonating the explosive charges releases the firing head and self-releasing plug from the apparatus, whereby the interior bore is fully open after detonation and substantial disintegration of the charge carrier and explosive charges. The firing head and self-releasing plug can be allowed to fall downwardly through the tubular assembly into the well bore below the apparatus or the firing head can be retrieved to the well surface after detonation. After firing the perforating apparatus, the production interval is then logged by lowering logging tools downwardly from the well surface through the tubing string and through the now open interior bore of the now perforated tubular assembly to the producing zone.

Additional objects, features and advantages will be apparent in the written description which follows.

DETAILED DESCRIPTION OF THE INVENTION

Figure 4:
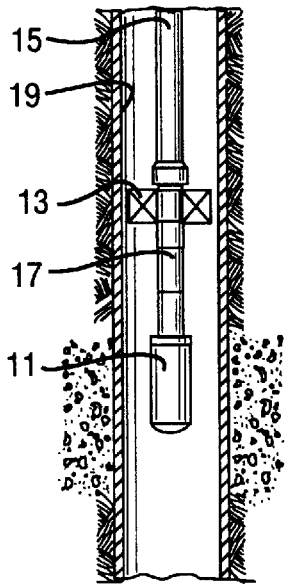
FIG. 4 Prior Art
FIGS. 4–7 are schematic views of a prior art perforation operation showing the release of the perforating gun portion of the device from the remainder of the tubular string after firing.

In order to best illustrate the advantages of the present invention, FIGS. 4–7 show a prior art perforating operation using a tubing conveyed perforating gun which is dropped to the bottom of the well bore after firing. Referring to FIG. 4, a typical prior art perforating system is shown which includes a perforating gun 11 which is run below a well packer 13 and which is connected to a tubing string 15 by a disconnect sub 17. The tubing string 15 extends to the well surface (not shown) of the cased well bore 19.

Figure 5:
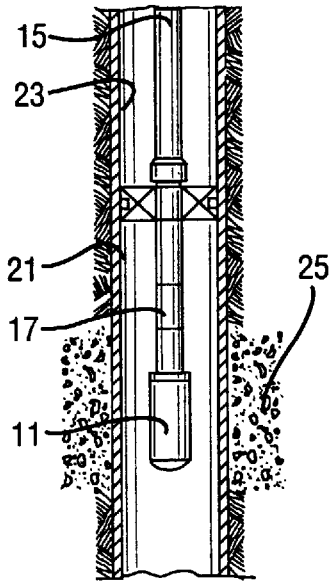
FIG. 5 Prior Art

As shown in FIG. 5, the packer is set at the desired location which isolates a lower borehole portion 21 from an upper borehole portion 23 and which locates the perforating apparatus adjacent a production interval 25.

Figure 6:
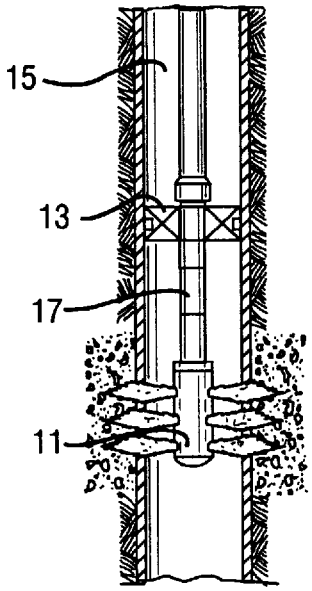
FIG. 6 Prior Art
Figure 7:
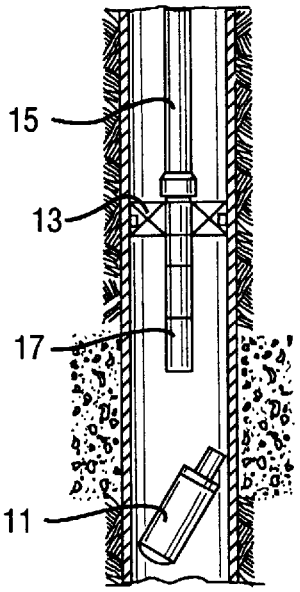
FIG. 7 Prior Art

As shown in FIG. 6, the perforating apparatus 11 is then actuated to perforate the well casing 19 adjacent the production interval 25. This can be accomplished, in the case of a percussion detonated device by passing a weight down the interior of the tubing string from the well surface to contact a percussion detonator. Such devices are well known in the art, for example, U.S. Pat. No. 2,876,843 to Huber, issued Mar. 10, 1959, shows such a tubing conveyed perforating apparatus in which a weight contacts a percussion detonator to fire the perforating guns. As shown in FIG. 7, the disconnect sub is then actuated to release the perforating apparatus, thereby allowing the apparatus to drop to the bottom of the well bore. As discussed previously, this type technique has several disadvantages including the presence of additional relatively large debris in the well which must be accommodated by drilling a rat hole.

Turning to FIGS. 1A–3A, there is shown the tubing conveyed perforating apparatus of the invention, designated generally as 27. The perforating apparatus 27 includes a tubular assembly made up of a plurality of tubular sections 31, 33, 35. Each tubular section has a generally cylindrical exterior and a generally concentric interior bore (37 in FIG. 1A). The tubular assembly has an upper connecting end (not shown) for connection in the tubing string (15 in FIG. 4) leading to the well surface and has a lower end (39 in FIG. 3A).

Figure 1A:
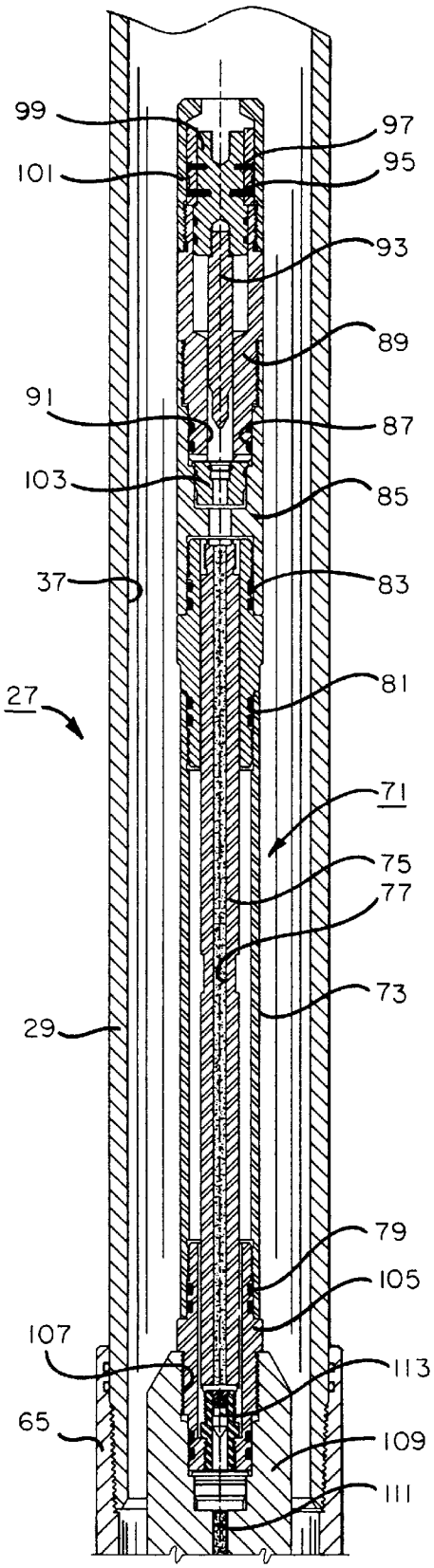
FIG. 1A is a side, cross-section view of the upper end of the tubing conveyed perforating apparatus of the invention in the running-in position.
Figure 1B:
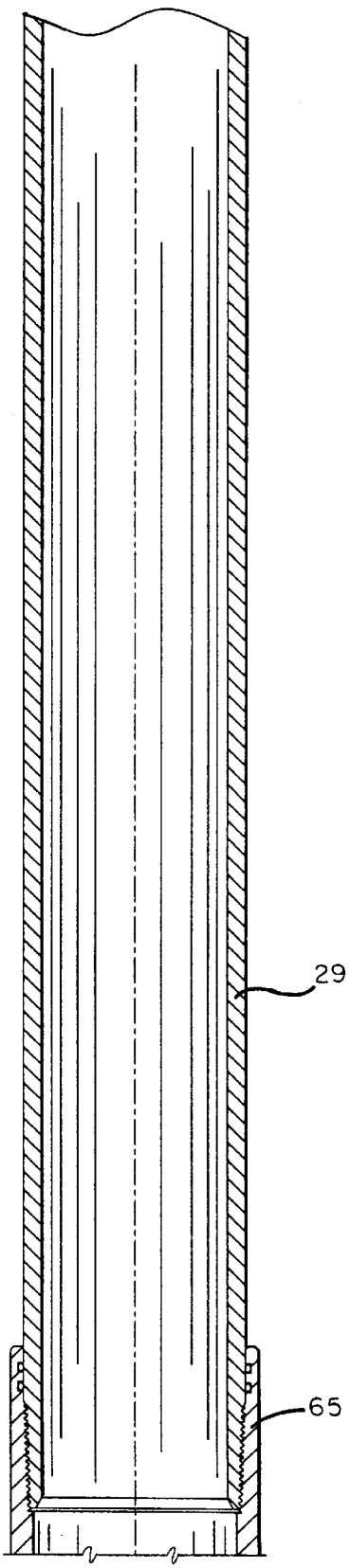
FIG. 1B is a side, cross-sectional view of the apparatus of FIG. 1A after firing and release of the firing head.
Figure 2A:
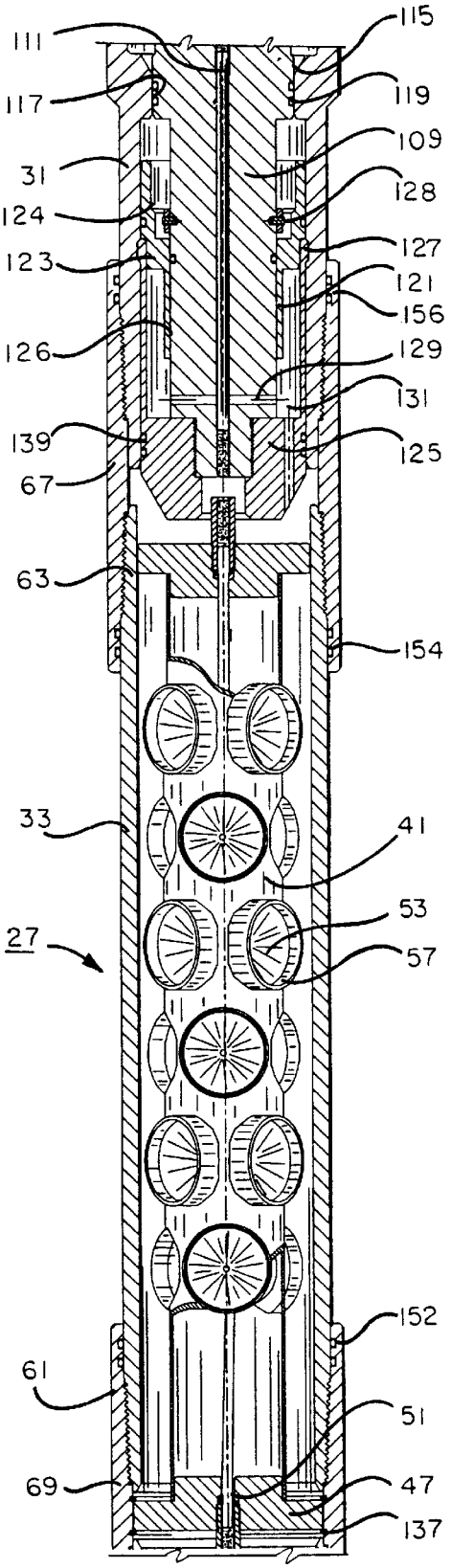
FIG. 2A is a downward continuation of FIG. 1A showing the lower end of the firing head and one of the charge holders of the apparatus.
Figure 3A:
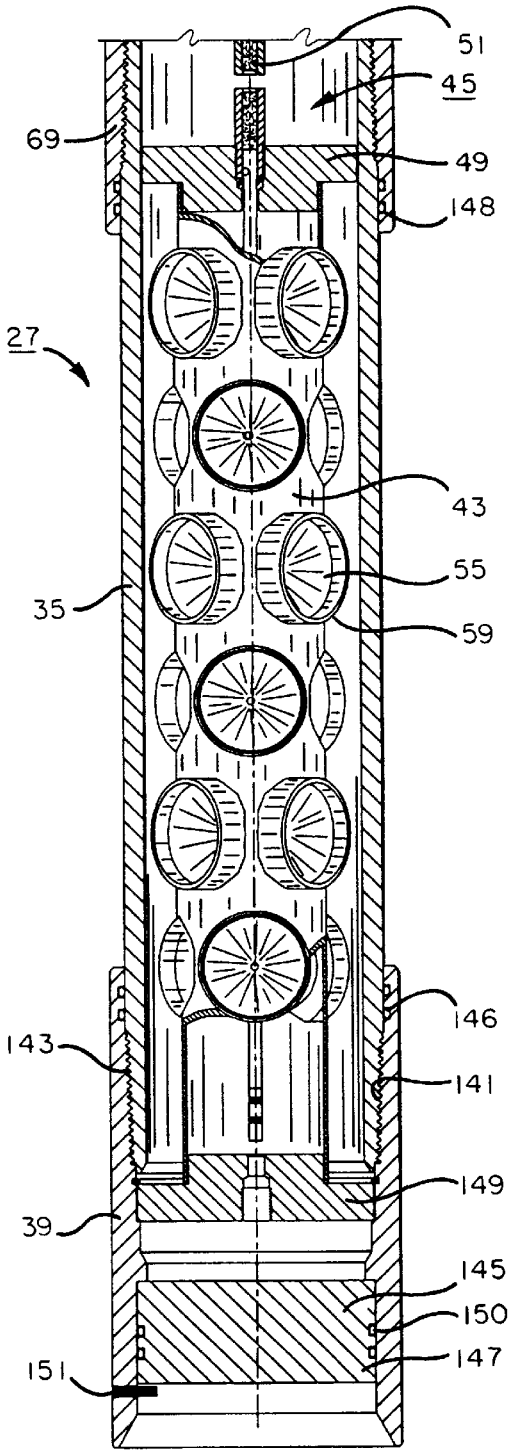
FIG. 3A is a downward continuation of FIG. 2A showing another charge holder and the self-releasing plug of the apparatus.
Figure 3B:
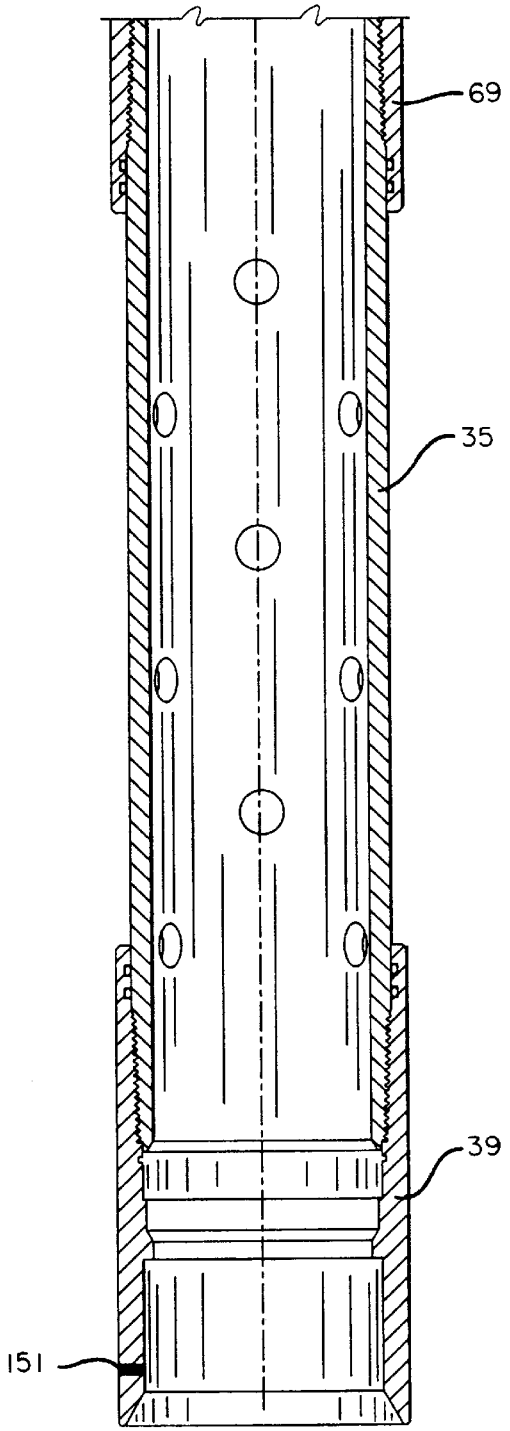
FIG. 3B is a downward continuation of FIG. 2B showing the full bore interior of the tubular assembly after firing.

A plurality of elongate charge holders (41, 43 illustrated in FIGS. 2A and 3A) are located within the interior bore 37 of the tubular assembly and are ballistically connected by means of bi-directional booster sections (e.g. section 45 in FIG. 3A). In the embodiment of FIGS. 2A and 3A, the booster sections 45 include upper and lower end caps 47, 49. A det cord 51 passes through a central bore of the booster components for actuating the depending explosive charges.

A plurality of shaped explosive charges (53, 55 in FIGS. 2A and 3A) are mounted along the length of each of the charge holders 41, 43 and are arranged in a selected pattern and orientation for producing the desired perforating pattern upon detonation.

Preferably, the explosive charges 53, 55 are shaped charges which have special charge cases formed of a material which will vaporize upon detonation leaving only a very fine dust remnant. The preferred charge cases 57, 59 will be a commercially available zinc alloy ZA-5. The shaped charge cases can be made of any material or combination of materials which will disintegrate upon detonation such as metal alloys, powdered metals, aluminum, glass or ceramics or combinations thereof. The charge holders 41, 43 are preferably made from wood or other suitable rigid organic composite material that burns and essentially vaporizes upon detonation of the shaped charges. Any of the other internal alignment components, such as the booster transfer components 45 and end caps 47, 49 would be made of similar materials to that of the charge holder. Other acceptable materials in addition to wood or other rigid organic materials include powdered metals, composites, plastics, aluminum, zinc, paper, glass, ceramics or combinations thereof. It is only necessary that the disintegratable material not leave large size debris such as strips of metal behind upon detonation.

Each of the tubular sections 29, 33 and 35 are generally cylindrical members having opposite externally threaded extents (61, 63 in FIG. 2A) which are connected in the tubular assembly by means of external collars 65, 67, 69, whereby the interior bore 37 of the tubular assembly which contains the charge holders 41, 43 is of generally constant internal diameter. By making up the tubular assembly with external threads 61 and couplings 69 (FIG. 2A), the I.D. of the assembly forms a generally slick interior surface after firing, as illustrated in FIGS. 1B–3B. In the typical perforating gun system, a "tandem" connector is utilized to attach multiple guns together end to end. The collar type connection of the apparatus of the invention allows the perforating system to remain full bore after firing. In addition to utilizing external couplings, integral joint (flush joint inside and outside) connections could also be employed.

As shown in FIGS. 1A–2A, a conventional TCP firing head 71 is located above the elongate charge holders 41, 43 within the interior bore 37 of the tubular assembly. The firing head 71 includes an outer tubular body 73 which surrounds an inner tubular body 75, the inner tubular body having an internal bore 77 for containing a pyrotechnic material. Appropriately located O-ring seal sections 79, 81, 83 isolate the internal bore 77. A sub 85 has an internal bore 87 in which is located plug 89 having a bore 91 through which a firing pin 93 can travel upon release of the shear means such as pins 95, 97 which initially connect the firing piston 99 within an external coupling 101.

As will be appreciated by those skilled in the art, downward pressure exerted on the upper end 99 of the firing head drives the firing pin 93 downwardly to strike the percussion initiator 103, igniting the pyrotechnic powder in the bore 77.

The lower end 105 of the traditional firing head is threadedly received within an upper bore 107 of a novel support sub which includes a sub body 109 having an internal bore 111 containing a det cord which is ignited by the firing mechanism 113 of the head 71. As best seen in FIG. 2A, the sub body 109 has a region of relatively greater external diameter 115 which contacts a seal surface 117 including O-rings 119 of the specially machined tubular section 31 where it forms a sliding seal. The sub body 109 also has a region of lesser relative diameter 121 which is surrounded by a retaining sleeve 123 including an upper flange portion 124 and a lower flange portion 126. The retaining sleeve 123 initially prevents downward movement of the sub body 109 in the direction of the elongate charge holders 41. The retaining sleeve 123 is also surrounded by a collet 125 having upwardly extending collet fingers 127 which initially underlay the retaining sleeve 123 and contact a shoulder region thereof for supporting the retaining sleeve, and hence the sub body 109 in the position shown in FIG. 2A. A sleeve 128 is provided to initially resist the upward movement of the retaining sleeve 123.

Figure 2B:
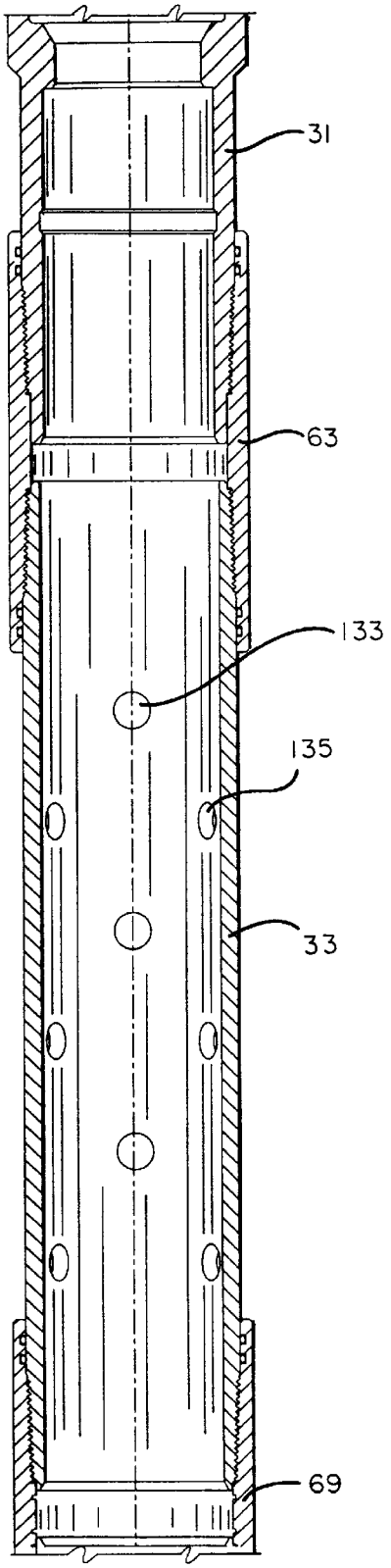
FIG. 2B is a downward continuation of FIG. 1B after firing the apparatus.

Upon actuation of the firing head 71 by any convenient means, the explosive gases pass from the central bore 111 through the radial bores 129 to the annular region 131, thereby driving the upper flange portion 124 of retaining sleeve 123 in an upward direction, whereby the collet fingers 127 collapse inwardly, releasing the sub body 109, and hence the entire firing head 71 so that the firing head is automatically released to fall through the interior bore of the tubular assembly and out the bottom thereof. FIG. 2B shows the interior of the special tubular section 31 and of the tubular section 33 after firing, the section 33 being perforated by holes 133, 135.

Referring again to FIGS. 2A and 3A, it will be appreciated that prior to firing the explosive charges, the charge holders 41 and explosive charges 53 were contained within an air-filled, atmospheric chamber created between the O-ring seals 150 in the plug 145 and the O-ring seals 146, 148, 152, 154, 156 provided between each tubular section and external collar. Thus, prior to firing, the explosive charges are initially isolated in an atmospheric chamber from the surrounding well bore fluids.

As shown in FIG. 3A, the tubular section 35 containing the second downwardly extending charge holder 43 terminates in a lower end member 39. Member 39 is a generally cylindrical body having an internally threaded surface 141 which threadedly engages the externally threaded lower extent 143 of the tubular section 35. The self-releasing plug 145 is located within the mouth opening 147 thereof below the charge carrier end cap 149. In the embodiment shown, the self-releasing plug 145 is made of a frangible material such as a ceramic which will fragment into many pieces upon firing of the perforating system. In the embodiment illustrated, the plug is a generally cylindrical disk having circumferential grooves for carrying external O-ring seals 150 and is initially held in position by means of one or more shear pins 151. The plug 145 could also be made from aluminum or cast iron.

In operation, the tubing conveyed perforating apparatus of the invention is run into position on a tubing string, such as string 15 shown in FIG. 4. After setting the packer in the well bore, the firing head is actuated, whereby the explosive powders within the bores 77, 111 ignite the explosive charges 53, 55 on the charge holders, thereby perforating the tubular sections 33, 35 and the surrounding well bore casing. The force of detonation causes opposite relative movement of the retaining sleeve 123 and its upper flange portion 124 and the collet fingers 127, releasing the firing head. The force of the detonation also shears the pins 151 allowing the bottom plug 145 to be ejected downwardly from the tubing assembly and/or fragments the plug. By manufacturing the charge holders and explosive charge cases of materials which disintegrate upon firing, these materials essentially vaporize leaving a full bore tubing interior as shown in FIGS. 1B–3B. Production fluids can then flow into the well bore annulus below the packer, into the interior of the tubular assembly and upwardly to the well surface. Logging tools and other equipment can be run downwardly from the well surface through the interior of the tubing string to the production interval.

An invention has been provided with several advantages. The perforating apparatus of the invention provides a full bore tubing string after firing so that logging tools and other instruments or devices can be run without danger of becoming stuck or damaged. The perforating apparatus of the invention provides an open bore subsequent to detonation without requiring that the perforating guns be dropped to the bottom of the well bore or without requiring a separate trip into the well to remove the guns. The design is simple and economical to manufacture.

While the invention has been shown in only one of its forms, it is not thus limited but is susceptible to various changes and modifications without departing from the spirit thereof. For example, the firing head could be located on the bottom of the tool instead of the top. It is also envisioned that the firing system could be concentric to the gun I.D. with a full opening valve being utilized to block the tubing string I.D. In addition to the external collars used to join the tubing sections, the tubing connections could be integral joints, as well. The bottom, self-releasing plug could be made of frangible material which would disintegrate into pieces upon firing.

What is claimed is:

1. A tubing conveyed perforating apparatus used in perforating a surrounding well bore, the apparatus comprising:

a tubular assembly made up of at least one tubular section, the tubular section having a generally cylindrical exterior and a concentric interior bore, the tubular assembly having an upper connecting end for connection in a tubing string extending to the well surface and a lower end;

an elongate charge holder located within the interior bore of the tubular assembly;

a plurality of explosive charges mounted on the charge holder;

a firing means for detonating the explosive charges to perforate the surrounding well bore; and wherein the charge holder and plurality of explosive charges are comprised of materials which substantially disintegrate upon detonation of the explosive charges, whereby the interior bore of the tubular assembly is fully open after detonation.

2. The tubing conveyed perforating apparatus of claim 1, wherein the firing means includes release means for automatically releasing the firing means upon detonation of the explosive charges, thereby allowing the firing means to separate from the perforating apparatus.

3. The tubing conveyed perforating apparatus of claim 1, wherein the firing means includes a connecting end for connection to a retrieval apparatus which is run from the well surface, whereby the firing means can be pulled from the well bore upon detonation.

4. The tubing conveyed perforating apparatus of claim 1, comprising a plurality of elongate charge holders ballistically connected end to end within the tubular assembly, and wherein the tubular assembly includes at least two tubular sections which contain the elongate charge holders and which are threadedly connected by external collars, whereby the interior bore of the tubular assembly which contains the charge holders is of generally constant internal diameter.

5. A tubing conveyed perforating apparatus used in perforating a surrounding well bore, the apparatus comprising:

a tubular assembly made up of at least one tubular section, the tubular section having a generally cylindrical exterior and a concentric interior bore, the tubular assembly having an upper connecting end for connection in a tubing string extending to the well surface and a lower end;

a plurality of elongate charge holders located within the interior bore of the tubular assembly and connected end to end;

a plurality of shaped explosive charges mounted along the length of each of the charge holders;

a firing head located above the elongate charge holders within the interior bore of the tubular assembly and initially sealing off the interior bore thereof from above, the firing head having firing means connected to the explosive charges for detonating the explosive charges to perforate the surrounding well bore;

a self-releasing plug mounted at the lower end of the tubular assembly initially sealing the interior bore thereof;

wherein the charge holder and plurality of explosive charges are comprised of materials which disintegrate upon detonation of the explosive charges, whereby the interior bore of the tubular assembly is fully open after detonation.

6. The tubing conveyed perforating apparatus of claim 5, wherein the firing head includes release means for automatically releasing the firing head upon detonation of the explosive charges, thereby separating the firing head from the perforating apparatus.

7. The tubing conveyed perforating apparatus of claim 5, wherein the firing head includes a connecting end for connection to a retrieval apparatus which is run from the well surface, whereby the firing head can be pulled from the well bore upon detonation.

8. The tubing conveyed perforating apparatus of claim 5, wherein the interior bore of the tubular assembly between the firing head and the self-releasing plug is initially sealed off from the surrounding well bore to form an air-filled, atmospheric chamber.

9. The tubing conveyed perforating apparatus of claim 5, wherein the charge holder and plurality of explosive charges are comprised of a material selected from the group consisting of wood and other rigid organic materials, plastics, aluminum, zinc, paper, glass, ceramics, powdered metal and other disintegratable composites and mixtures thereof.

10. The tubing conveyed perforating apparatus of claim 5, wherein the explosive charges are contained within surrounding charge cases, and wherein the charge cases are formed from zinc alloy, powdered metals, aluminum, glass, ceramics and combinations thereof.

11. The tubing conveyed perforating apparatus of claim 5, comprising a plurality of elongate charge holders ballistically connected within the tubular assembly, and wherein the tubular assembly includes at least two tubular sections which contain the elongate charge holders and which are threadedly connected by external collars, whereby the interior bore of the tubular assembly which contains the charge holders is of generally constant internal diameter.

12. A method of perforating a well bore having an upper borehole portion and a lower borehole portion including a production interval which is isolated from the well bore by a well casing or the like, the method comprising the steps of:

suspending a tubing conveyed perforating apparatus and a packer means from a tubing string at a subterranean location within the well bore;

setting the packer means within the well bore at a position which isolates the lower borehole portion of the well bore from the upper borehole portion thereof and which locates the perforating apparatus adjacent the production interval;

actuating the perforating apparatus to perforate the well casing adjacent the production interval to thereby allow production fluids to flow through the perforated interval, through a surrounding annular area of the well and upwardly through the tubing string to the well surface; and wherein the tubing conveyed perforating apparatus includes a tubular assembly made up of two or more tubular sections, each tubular section having a generally cylindrical exterior and a concentric interior bore, the tubular assembly being provided with an elongate charge holder which carries a plurality of explosive charges, and wherein the charge holder and explosive charges are formed from a disintegratable material which disintegrates during detonation of the explosive charges, whereby the interior bore of the tubular assembly is fully open after detonation.

13. The method of claim 12, wherein the tubular assembly is made up with a firing head which initially seals the interior bore at an upper end thereof and a self-releasing plug which initially seals a lower end thereof, and wherein the act of detonating the explosive charges releases the firing head and self-releasing plug from the interior bore of the tubular assembly, whereby the interior bore of the tubular assembly is fully open after detonation and disintegration of the charge carrier and explosive charges.

14. The method of claim 13, wherein the firing head and self-releasing plug are allowed to fall downwardly through the tubular assembly into the well bore below the apparatus.

15. The method of claim 13, wherein the firing head is retrieved to the well surface after detonation of the perforating apparatus by means of a retrieval apparatus which is run from the well surface to the firing head.

16. The method of claim 15, wherein the retrieval apparatus is a wireline or slick line.

17. The method of claim 13, further comprising the steps of:

logging the producing interval, after perforating the well casing, by lowering logging tools downwardly from the well surface, through the tubing string and through the now open interior bore of the tubular assembly.

18. The method of claim 13, wherein the self-releasing plug is formed from a material which is frangible upon detonation, wherein the plug fragments into pieces upon firing of the perforating apparatus.

19. The method of claim 13, wherein the tubular apparatus is made up of a plurality of elongate charge holders ballistically connected end to end within the tubular assembly, and wherein the tubular sections of the tubular assembly which contain the charge holders are threadedly connected by external collars, whereby the interior bore of the tubular assembly which contains the charge holders is of a generally constant internal diameter.

20. The method of claim 13, wherein the interior bore of the perforating apparatus between the firing head and the self-releasing plug is air-filled.

* * * * *